US008508382B1

(12) United States Patent
Novak

(10) Patent No.: US 8,508,382 B1
(45) Date of Patent: Aug. 13, 2013

(54) LIGHT EMITTING INFLATABLE SAFETY BEACON

(76) Inventor: John C. Novak, Lakeland, FL (US)

( * ) Notice: Subject to any disclaimer, the term of this patent is extended or adjusted under 35 U.S.C. 154(b) by 368 days.

(21) Appl. No.: 12/932,264

(22) Filed: Feb. 22, 2011

Related U.S. Application Data

(60) Provisional application No. 61/338,707, filed on Feb. 23, 2010.

(51) Int. Cl.
*G08B 5/00* (2006.01)
*G08B 23/00* (2006.01)
*B63C 9/00* (2006.01)

(52) U.S. Cl.
USPC ..... 340/815.4; 340/815.45; 340/984; 340/985; 340/321; 441/11; 441/13; 441/23; 441/80; 441/88; 441/89; 114/329; 362/477; 116/107; 116/110; 116/210

(58) Field of Classification Search
USPC ..... 340/815.4, 984, 985; 441/23, 80, 441/88, 89; 114/329
See application file for complete search history.

(56) References Cited

U.S. PATENT DOCUMENTS

| | | | | |
|---|---|---|---|---|
| 3,914,813 | A | 10/1975 | Berchielli | |
| 4,475,476 | A | 10/1984 | Howard | |
| 4,922,848 | A | 5/1990 | Thiel | |
| 5,034,847 | A | 7/1991 | Brain | |
| 5,117,344 | A * | 5/1992 | Perez | 362/352 |
| 5,218,366 | A | 6/1993 | Cardamone | |
| 5,367,306 | A | 11/1994 | Hollon | |
| 5,520,486 | A | 5/1996 | Van Wyck | |
| 5,855,454 | A | 1/1999 | Courtney | |
| 5,907,281 | A | 5/1999 | Miller | |
| 6,032,607 | A | 3/2000 | Ashline | |
| 6,042,302 | A | 3/2000 | Cook | |
| 6,080,027 | A | 6/2000 | Rodemann | |
| 6,332,424 | B1 | 12/2001 | Frink | |
| 6,386,137 | B1 | 5/2002 | Riche | |
| 6,688,253 | B2 | 2/2004 | Frink | |
| 7,059,737 | B2 * | 6/2006 | Oswald | 362/101 |
| 7,232,354 | B2 | 6/2007 | Olson | |
| 7,388,512 | B1 | 6/2008 | Moorer | |
| 7,492,251 | B1 | 2/2009 | Katz | |
| 7,540,796 | B2 | 6/2009 | Spears | |
| 2006/0196499 | A1 | 9/2006 | Cannizzaro | |

* cited by examiner

*Primary Examiner* — Donnie Crosland
(74) *Attorney, Agent, or Firm* — Frijouf, Rust & Pyle, P.A.

(57) ABSTRACT

A light emitting inflatable safety beacon is disclosed for identifying a location of the beacon. The beacon comprises an elongated bladder defining an interior chamber extending between an upper end and a lower end. A tether extends between a first end and a second end. A couple links the tether with the elongated bladder for suspending the tether within the interior chamber. A light source is secured to the tether for emitting an electromagnetic radiation. The electromagnetic radiation internally illuminates the elongated bladder for creating an illuminated beacon. The electromagnetic radiation traverses the elongated bladder for creating a location beacon.

11 Claims, 7 Drawing Sheets

LIGHT EMITTING INFLATABLE SAFETY BEACON

CROSS-REFERENCE TO RELATED APPLICATIONS

This application claims benefit of U.S. Patent Provisional application Ser. No. 61/338,707 filed Feb. 23, 2010. All subject matter set forth in provisional application Ser. No. 61/338,707 is hereby incorporated by reference into the present application as if fully set forth herein.

BACKGROUND OF THE INVENTION

1. Field of the Invention

This invention relates to safety beacons and more particularly to a light emitting device for illuminating an inflatable safety beacon.

2. Background of the Invention

History has shown that man has been free diving since 3000 BC. The next step in the evolution of diving was the invention of the diving bell and by 1774 LeHavre developed a diving helmet with surface supplied compressed air. In 1924, Yves le Prieur developed a self contained breathing apparatus utilizing manual valve actuation. The Aqualung, a demand type self contained breathing apparatus (SCUBA) was developed by Cousteau and Gagnan in the early 1940s. This device evolved into the present modern day SCUBA units.

Through the years, equipment was developed to make diving a much safer activity as its popularity increased. The equipment provided the divers the opportunity to explore new areas as well as experience the phenomena of night diving. Along with the myriad of equipment designed to make subsurface activities safer, other equipment was developed to ensure the safety, rescue and retrieval of divers upon reaching the surface. Such equipment includes a fully inflated buoyancy compensator as well as the so-called SCUBA sausage, an inflatable pole-like signaling device. For night diving, various strobe and signaling devices have been developed. The need still exists for a readily visible, day or night, device capable of alerting an observer as to the presence and location of a diver in the water. There have been many in the prior art who have attempted to solve these problems with varying degrees of success. None, however completely satisfies the requirements for a complete solution to the aforestated problem. The following U.S. patents are attempts of the prior art to solve this problem.

U.S. Pat. No. 5,893,786 to Stevens discloses an automatic, telescoping, buoyant identification device for use with a water sports life vest having an otherwise conventional life vest/floatation device that is equipped with a telescoping spotting pole or flag mounted to the back of the vest. The spotting pole, constructed of a buoyant foam, slides freely within a tubular main housing such that when the wearer becomes submerged, the spotting pole automatically telescopes from the main housing into the air. It is envisioned that the spotting pole has a visible identification device, such as a flag, mounted on its end. The identification device is colored in a manner such that it will be highly visible to approaching boaters. It is envisioned that the present invention may also be sold as an add-on kit. The unit will attach to existing life vests using fastening devices, such as hook and loop fasteners, ties or belts. It is envisioned that the spotting pole and main housing will be manufactured of a material selected from the group comprising plastic and foam.

U.S. Pat. No. 5,520,486 to Van Wyck discloses a method and apparatus for identifying a down diver in distress comprising activating automatic inflation means. The inflation means inflates a tube, and activates automatic signal means, to provide sensory indication of a diver in distress, releasing the tube and the signal means away from a diver's body, allowing the tube and the signal means to float to the surface of the water and signalling for help with the signal means.

U.S. Pat. No. 5,855,454 to Courtney, et al. discloses a counterweight assembly to enhance heads up surface positioning of a person. The assembly includes a weight/ballast member strategically disposed on a cylinder/tank worn by a diver during a dive. The weight member can be attached by several different embodiments. Preferably, the weight member is attached such that the diver cannot release or adjust the weight member while he or she is diving. The weight member rotates the person to ensure heads up surface positioning in the event the person becomes incapacitated. Also provided are several other water safety and survival devices.

U.S. Pat. No. 6,032,607 to Ashline discloses an aerial lift balloon and signaling components attached thereto and stored within a closure member held assembled with a breakaway housing to form a package storing an inflating device for the balloon. Removal of the closure member initiates inflation of the balloon and operation of the signaling components, while removal of an end cover of the package permits separation of the breakaway housing enabling the positioning of the inflating device by a flotation collar portion of the package for aerial launching of the balloon. A stroboscopic light suspended between the floatation collar and the aerial lift balloon provides enhanced visibility of the signal device.

U.S. Pat. No. 6,042,302 to Cook discloses a dive rescue search device having a stanchion with a locating mechanism for the device, a marking device to assist the diver and a search area marker to properly direct the search.

U.S. Pat. No. 6,080,027 to Rodemann discloses compact and light weight deployable flotation devices with improved elasticity, tensile strength, shear strength, and puncture resistance using higher quality materials and sequencing of layers of polymer coating with greater mechanical strength in outer layers, and improved impermeability to gas leakage from within. The flotation devices are folded in containers with the containers having an integral gas supply cannister for use in a vehicle or vessel and for portability. The flotation devices are deployed by inflation by means of mechanical pull cord, automatically by float switches, hydrostatic release, electronic panic buttons, or switches used with a pyrotechnic release valve mechanism, or by pyrotechnic inflators. Restraining mechanisms form part of inflatable bag construction for permanent mounting in a vehicle or vessel. A protective cover enshrouds the inflatable bag and its integral restraining mechanism, the shroud being able to expand at the end of bag inflation.

U.S. Pat. No. 6,332,424 to Frink discloses a hands free signal device for use in conjunction with a scuba system. The hands free signal device includes an inflatable member engaged with an inflation source. The inflation source, for example, can be a tank of compressed air commonly used in scuba diving or can be a smaller, self-contained cylinder of carbon dioxide. The signaling device is adapted for use in conjunction with a scuba diving buoyancy compensation jacket and is activated by pulling on a cord within easy reach of the scuba diver.

U.S. Pat. No. 6,386,137 to Riche discloses a rescue signal device for indicating the location of a person requiring rescue attention. The rescue signal device includes a canister. The canister has a lumen therein adapted for holding helium under relatively high pressure. The canister has an aperture therein for access into the lumen. A valve means releases the helium from the canister. The valve means is fluidly mounted to the aperture in the canister. A balloon has an opening therein. An elongate tube has a first end and a second end. The first end of the tube is fluidly coupled to the valve means. The second end of the tube is fluidly coupled to the opening in the balloon, such that the helium may enter the balloon via the tube.

U.S. Pat. No. 6,688,253 to Frink discloses a hands free signal device for use in conjunction with a scuba system. The hands free signal device includes an inflatable member engaged with an inflation source. The inflation source, for example, can be a tank of compressed air commonly used in scuba diving or can be a smaller, self-contained cylinder of carbon dioxide. The signaling device is adapted for use in conjunction with a scuba diving buoyancy compensation jacket and is activated by pulling on a cord within easy reach of the scuba diver.

U.S. Pat. No. 7,232,354 to Olson, et al. discloses a device which provides buoyancy to objects with negative buoyancy in water. The invention comprises a water-sensitive trigger which, when activated, causes a compressed gas to exit a canister and enter a balloon, which expands, thereby causing the object to float, in cases where the device is attached to an item on a boat, or rise to the surface, in cases where the device is attached to a sunken object. There are a number of variable characteristics, including canister size, trigger fuse length, balloon configuration, and housing material that allow a user tremendous flexibility in selecting a proper size of the invention for the user's intended purpose. Other iterations of the invention provide breathing air for underwater purposes and means of keeping cars, boats, airplanes, etc., floating when they fall into water.

U.S. Pat. No. 7,540,769 to Spears, et al. discloses a device which provides buoyancy to objects with negative buoyancy in water. The invention comprises a water-sensitive trigger which, when activated, causes a balloon to inflate, causing the object to float upon the surface where the user can then easily and safely retrieve it, through one of two mechanisms: first, a compressed gas is allowed to exit a canister and enter a balloon, second, one or more substances which, when mixed with water will produce bubbles are exposed to water and the balloon is filled with bubbles from the chemical reaction. There are a number of variable characteristics, including canister size and shape, trigger fuse length, balloon configuration, and housing material that allow a user tremendous flexibility in selecting a proper size of the invention for the user's intended purpose.

Although the aforementioned prior art have contributed to the development of the art of diving safety devices, none of these prior art patents have solved the needs of this art.

Therefore, it is an object of the present invention to provide an improved apparatus for the alerting of an observer.

Another object of this invention is to provide an improved alerting apparatus for effective day or night use.

Another object of this invention is to provide an improved apparatus that is simple for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved a light emitting inflatable safety beacon for identifying a location of the beacon. The beacon comprises an elongated bladder defining an interior chamber extending between an upper end and a lower end. A tether extends between a first end and a second end. A couple links the tether with the elongated bladder for suspending the tether within the interior chamber. A light source is secured to the tether for emitting an electromagnetic radiation. The electromagnetic radiation internally illuminates the elongated bladder for creating an illuminated beacon. The electromagnetic radiation traverses the elongated bladder for creating a location beacon.

In a more specific embodiment of the invention, the tether includes an electric conduit. A current source is secured to the elongated bladder and electrically coupled to the electric conduit. The light source includes a plurality of light-emitting diodes electrically coupled to the electric conduit. A current control device opens or closes the current path between the current source and the plurality of light-emitting diodes.

In one embodiment of the invention, a sealing plug traverses the elongated bladder for receiving the electric conduit. The current source is secured to the sealing plug for positioning the current source outside of the interior chamber and electrically coupled to the electric conduit.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 2:
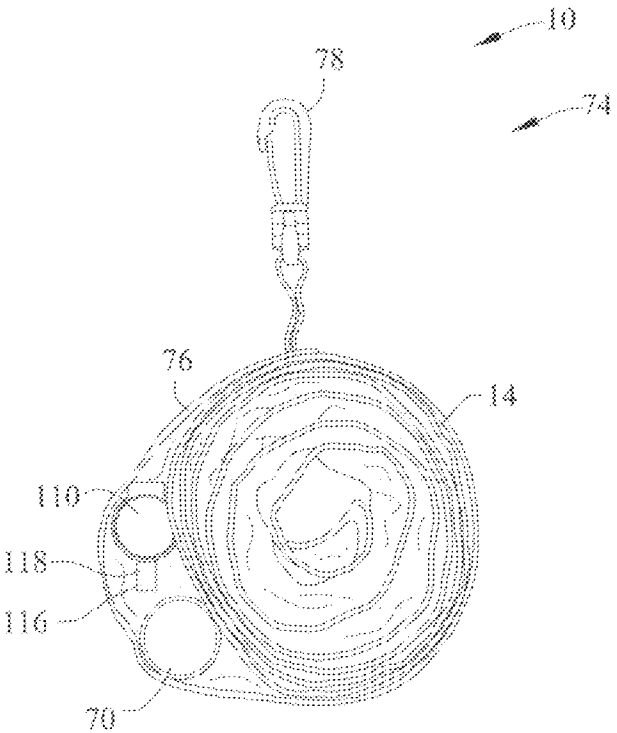
FIG. 2 is a top view of the safety beacon of FIG. 1 in a coiled position.
Figure 1:
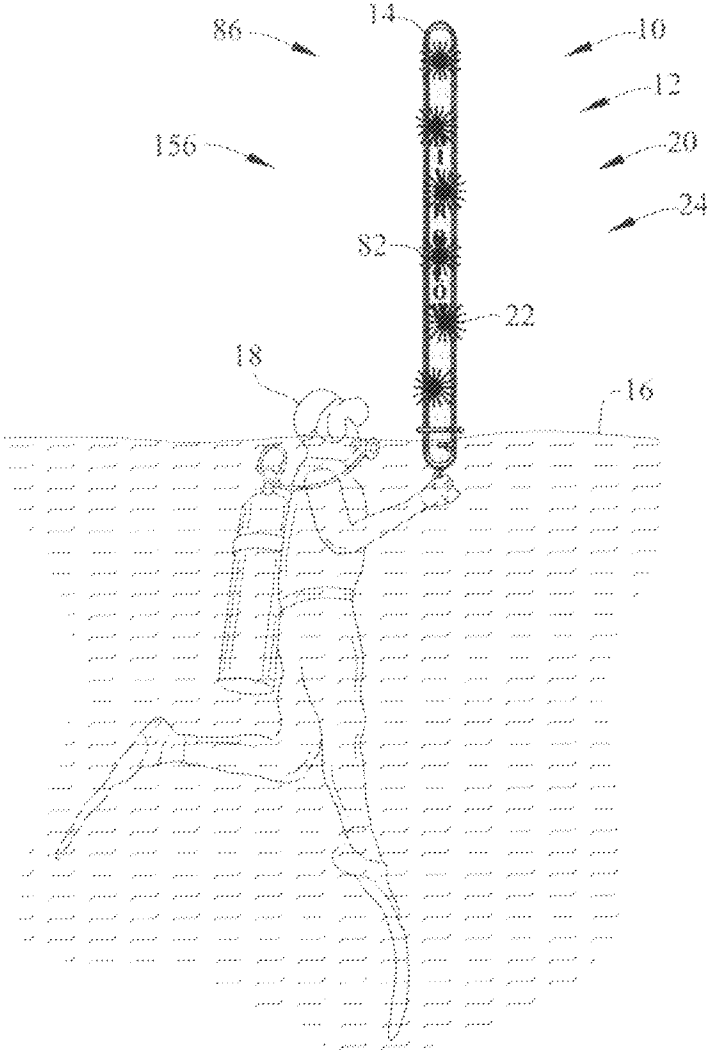
FIG. 1 is a side elevation view of a light emitting inflatable safety beacon of the present invention.

FIGS. 1-18 are various view of a light emitting inflatable safety beacon 10 for identifying a location 12 of the beacon 10. The light emitting inflatable safety beacon 10 is shown as an inflatable safety sausage 14, however may include other inflatable safety beacons. The inflatable safety sausage 14 is typically utilized in a body of water 16 by an individual 18 diving or other water activity. The inflatable safety sausage 14 can be deployed in a distressed condition for increasing visibility of the individual's position 20.

The beacon 10 may be constructed from a first half cylindrical portion 30 having an interior surface 32, an exterior surface 34 and first peripheral lip 36 extending about the first half cylindrical portion 30. The beacon 10 may be further constructed from a second half cylindrical portion 40 having an interior surface 42, an exterior surface 44 and a second peripheral lip 46 extending about the second half cylindrical portion 40. The first half cylindrical portion 30 and second half cylindrical portion 40 may be constructed from polymeric woven material 50 or other flexible materials.

Figure 3:
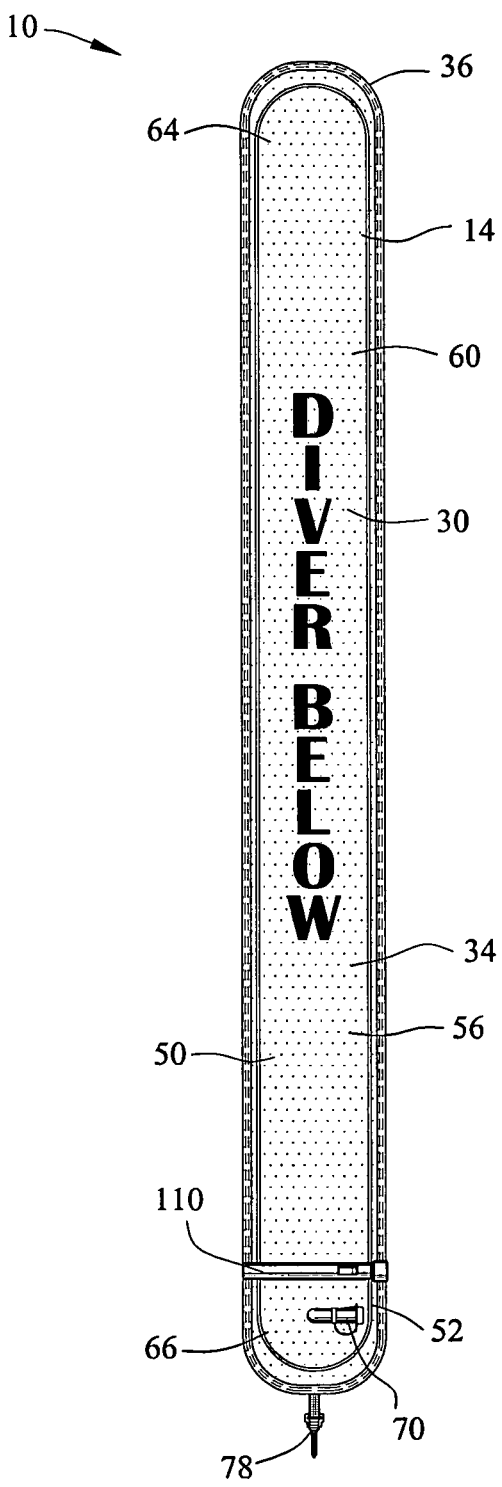
FIG. 3 is a front view of the safety beacon of FIG. 1 in a deflated condition.
Figure 4:
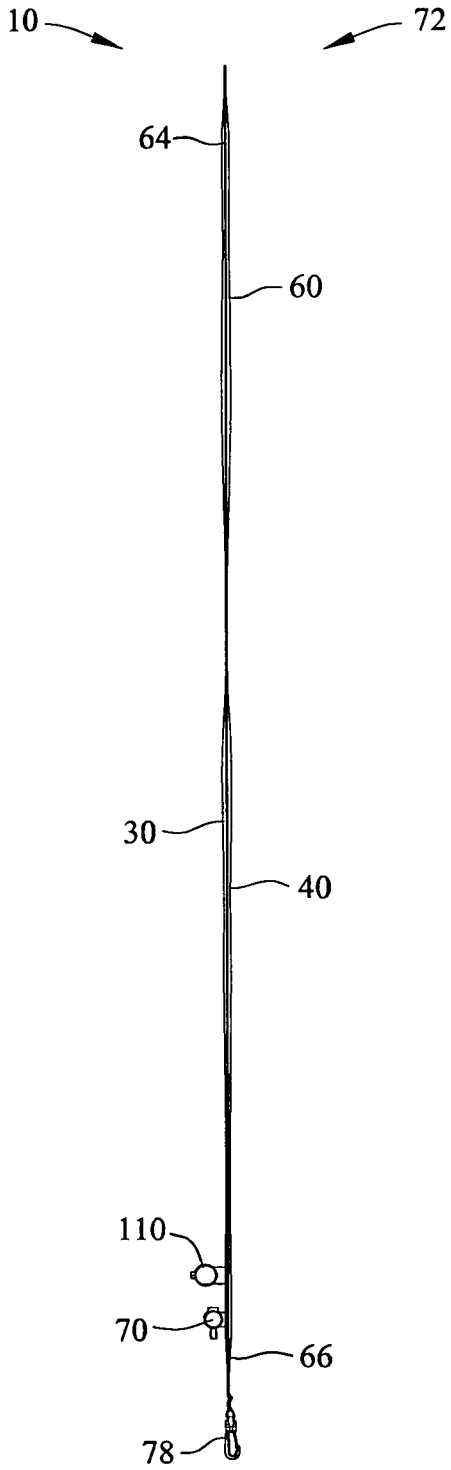
FIG. 4 is a side view of FIG. 3.
Figure 5:
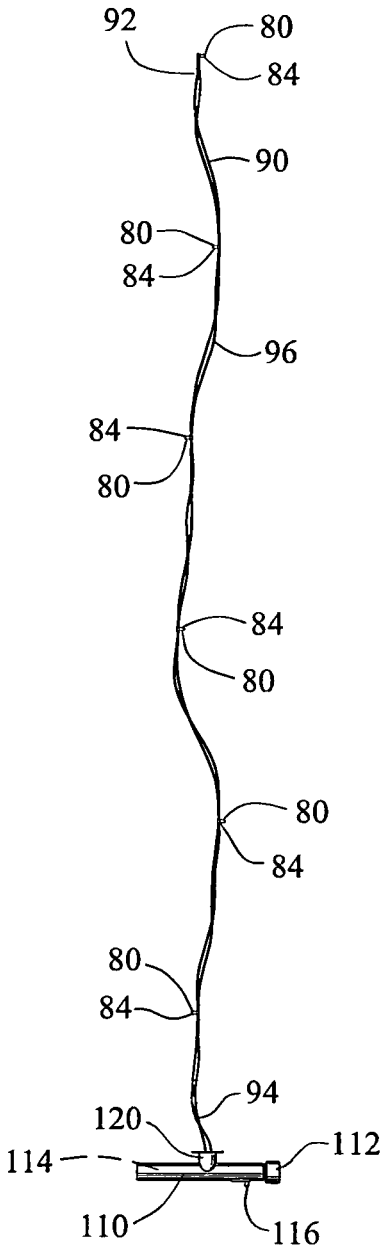
FIG. 5 is a front view of a light emitting device for illuminating an inflatable safety beacon as shown in FIG. 1.
Figure 6:
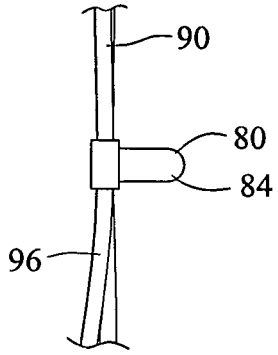
FIG. 6 is an enlarged portion of FIG. 5 illustrating an electric conduit and a light source.

The first half cylindrical portion 30 is mated with the second half cylindrical portion 40 by heat fusing 52, stitching, gluing and/or other fastening means the first peripheral lip 32 to the second peripheral lip 42. The joining of the first half cylindrical portion 30 with the second half cylindrical portion 40 defines an elongated bladder 60 defining an interior chamber 62 extending between an upper end 64 and a lower end 66. A sealing layer 54 may be applied to both the interior surface 32 of the first half cylindrical portion 30 and the interior surface 42 second half cylindrical portion 40 for creating an air tight seal within the elongate bladder 60. The elongated bladder 60 preferably includes a translucent material 56 for permitting passage of light through elongated bladder 60. The elongated bladder 60 includes a valve 70 for permitting the inflation and deflation of the elongated bladder. As shown in FIGS. 3 and 4 the elongated bladder 60 is evacuated of air for retracting the elongated bladder 60 into a flat position 72. While in the flat position 72, the elongated bladder 60 may be placed into a coil configuration 74 as shown in FIG. 2. The coil configuration 74 facilities storing and transporting of the beacon 10. A hook and loop strap 76 may be utilized for encircling a portion or the entire coil configuration 74 for maintaining the beacon 10 in the coil configuration 74. The beacon 10 may further include a clip 78 securing to the elongated bladder 60. The clip 78 retains the elongated bladder 60 to the individual 18 or other object.

In order to increase visibility of the beacon 10 in reduced surrounding lighting, the beacon 10 incorporates a light source 80 positioned within the elongated bladder 60. The light source 80 emits an electromagnetic radiation 82 that may include visible light, infrared radiation, ultraviolet radiation, or radiation. To product visible light, the light source 80 may include a glow stick utilizing a chemical reaction-induced chemiluminescence, incandescent, fluorescent, light-emitting diode (LED) 84 or other light source 80. In order to increase of area of electromagnetic radiation 82, the light source 80 may include a plurality of light sources 86. The electromagnetic radiation 82 internally illuminates the elongated bladder 60 for creating an illuminated beacon 22. Furthermore, the electromagnetic radiation 82 traversing the translucent and elongated bladder creates a location beacon 24.

Figure 7:
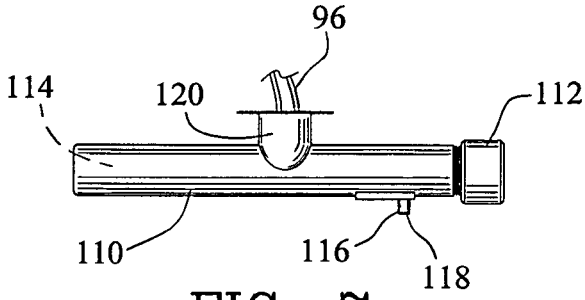
FIG. 7 is an enlarged portion of FIG. 5 illustrating the electric conduit and a current source.
Figure 10:
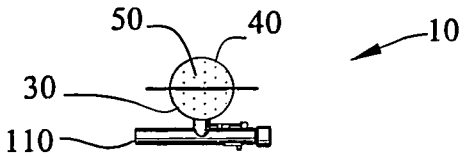
FIG. 10 is a top view of FIG. 8.
Figure 8:
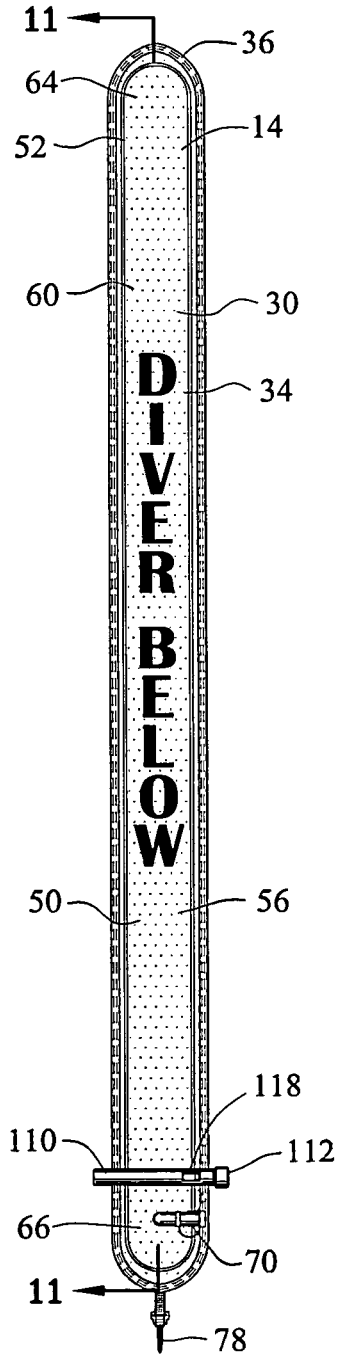
FIG. 8 is a front view of the safety beacon of FIG. 1 in an inflated condition.
Figure 9:
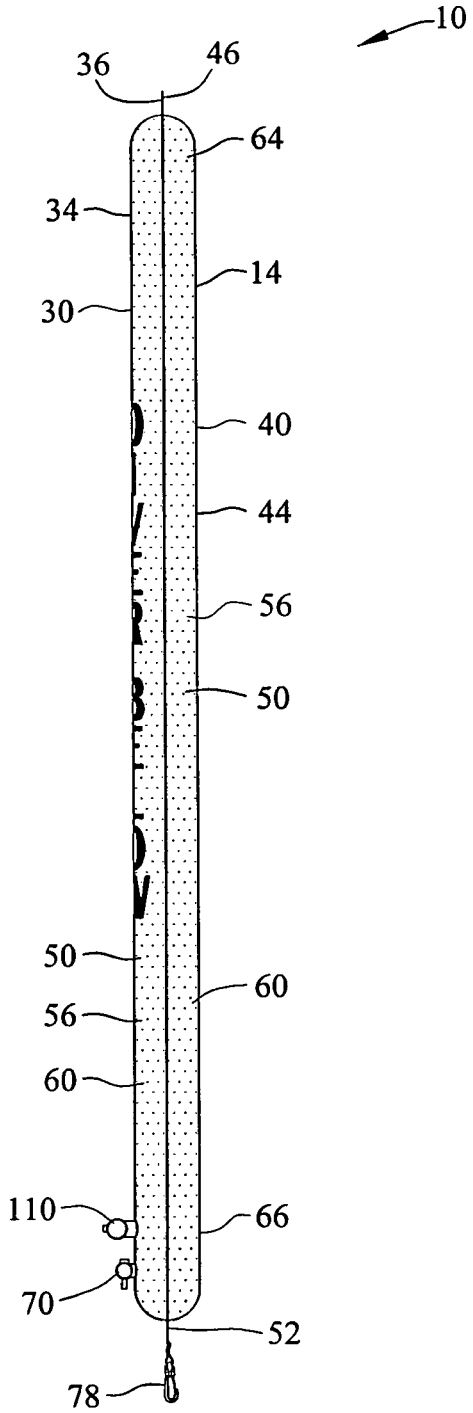
FIG. 9 is a side view of FIG. 8.
Figure 12:
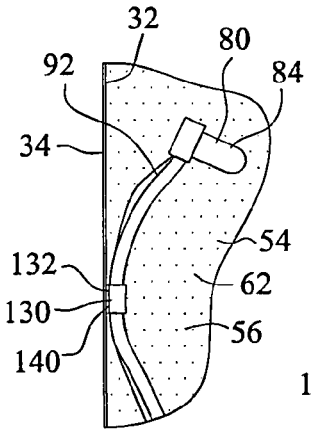
FIG. 12 is an enlarged portion of FIG. 11 illustrating a couple linking the electric conduit to an elongated bladder.
Figure 13:
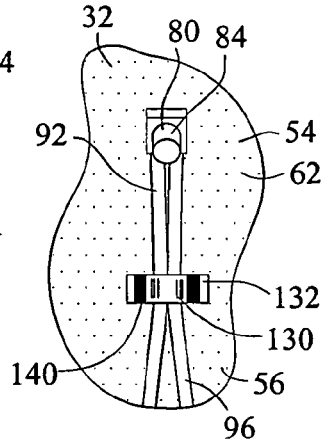
FIG. 13 is a front view of FIG. 12.
Figure 14:
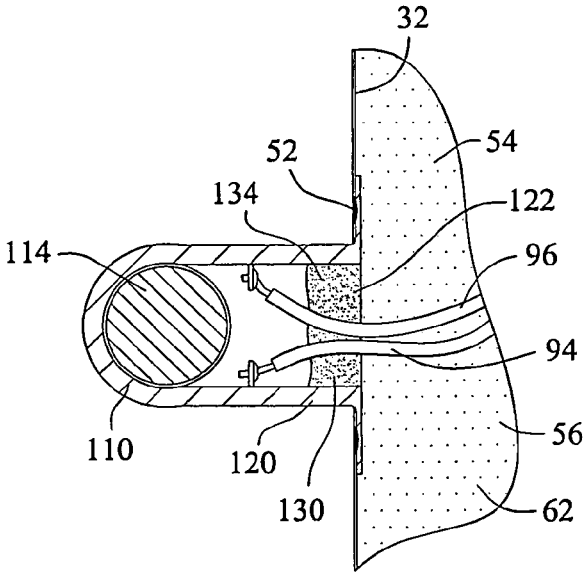
FIG. 14 is an enlarged portion of FIG. 11 illustrating the electric conduit electrically coupled to the current source.

As shown in FIGS. 5-7 and 11-16, a tether 90 extends between a first end 92 and a second end 94 and is secured to the light source 80. The tether 90 may include an electric conduit 96. The electric conduit 96 electrically couples the light source 80 to a current source 110. As best seen in FIGS. 7 and 14, a plug base 120 traversing the elongated bladder 60 for receiving the electric conduit 96 and positioning a portion of the electric conduit 96 outside of the interior chamber 62. The current source 110 is secured to the plug base 120 for positioning the current source 110 outside of the interior chamber 60 and receiving the electric conduit 96. The plug base 120 may be secured to the elongated bladder 60 by heat fusing 52, stitching, gluing and/or other fastening means.

The current source 110 includes a removal cap 112 for accessing one or more batteries 114. A current control device 116 is positioned in series in the electric conduit 96 for opening or closing the current path between the current source 110 and the light source 80. The current control device 116 may include a manual switch, automatic switch to close the current path upon the contact with water 118, or other electrical components.

Figure 11:
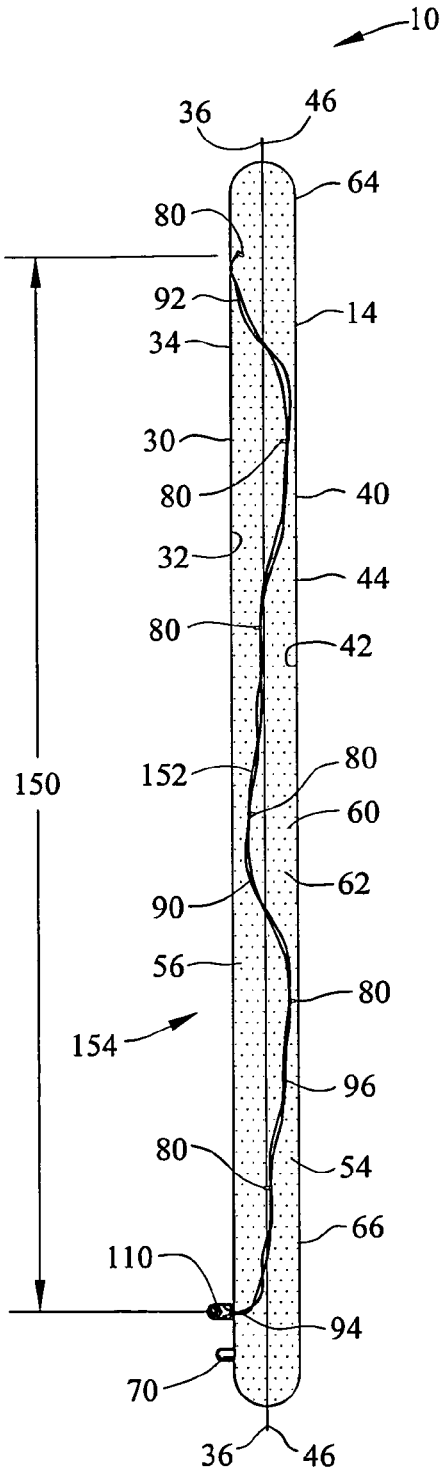
FIG. 11 is a sectional view along line 11-11 in FIG. 8.

As seen in FIGS. 11-16, a couple 130 linking the tether 90 with the elongated bladder 60. The couple 130 suspends the tether 90 within the interior chamber 62. Preferably, the couple 130 includes an upper couple 132 and a lower couple 134. FIGS. 11-13 illustrate a first embodiment of the upper couple 132 including an interior surface strap 140 linking the first end of the tether 90 to the interior surface 32 of the first half cylindrical portion 30. Preferably, the interior surface strap 140 is positioned to the upper end 64 of the elongated bladder 60. The interior surface strap 140 may also be constructed from a polymeric woven material 50 or other flexible materials and may be secured by heat fusing 52, stitching, gluing and/or other fastening means.

Figure 15:
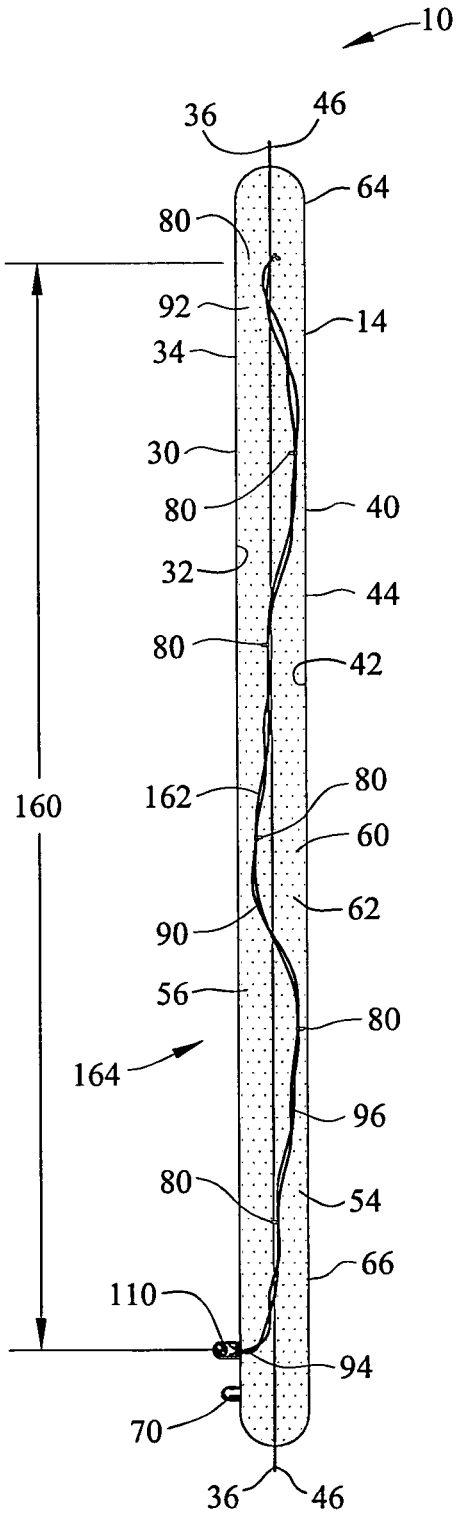
FIG. 15 is a view similar to FIG. 11 illustrating a strap linking the electric conduit to an upper end of the elongated bladder.
Figure 16:
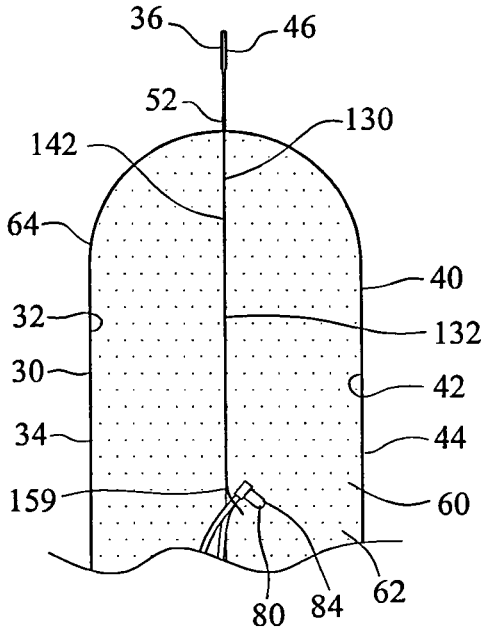
FIG. 16 is an enlarged portion of FIG. 15.
Figure 17:
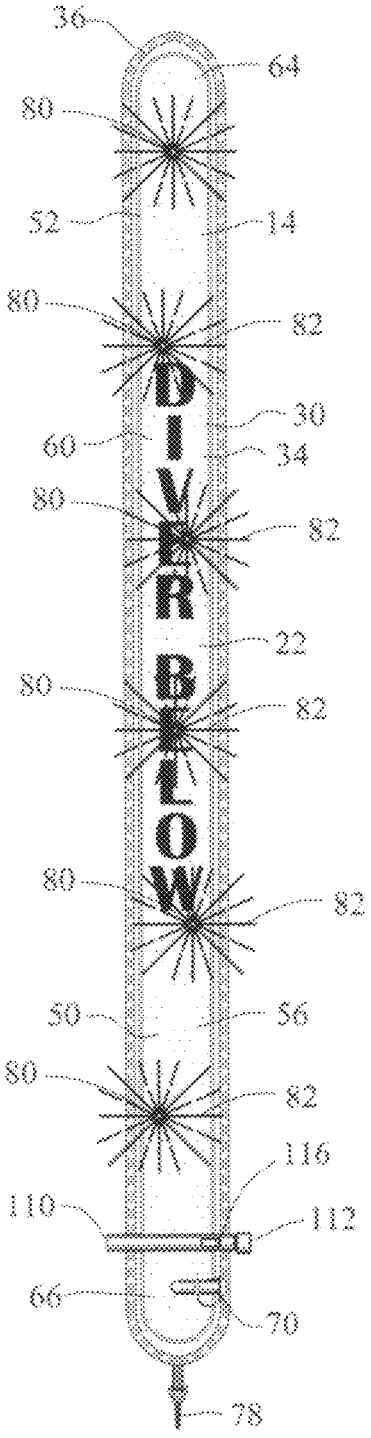
FIG. 17 is an enlarged portion of FIG. 1 illustrating a plurality of light sources having a non-aligning orientation within the elongated bladder.
Figure 18:
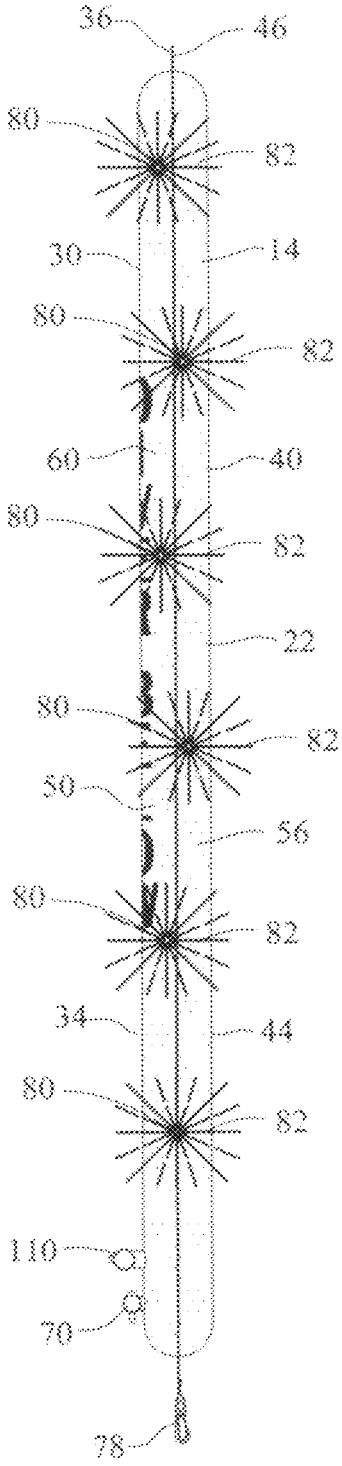
FIG. 18 is a side view of FIG. 17.

FIGS. 15 and 16 illustrate a second embodiment of the upper couple 132 including a peripheral strap 142 linking the first end of the tether 90 between the first peripheral lip 36 and the second peripheral lip 46. Preferably, the peripheral strap 142 is positioned to the upper end 64 of the elongated bladder 60. The peripheral strap 142 may also be constructed from a polymeric woven material 50 or other flexible materials and may be secured by heat fusing 52, stitching, gluing and/or other fastening means.

FIGS. 14 and 15 illustrate the lower couple 134 linking the second end 94 of the tether 90 to the lower end 66 of the elongated bladder 60. The lower couple 134 may comprise the sealing plug 122 positioned within the plug base 120. The sealing plug 120 prevents the movement of the electric conduit 96 relative to the sealing plug 120 and prevents moisture traversing between the elongated bladder 60 and the current source 110.

As shown in FIG. 11 the positioning of the interior surface strap 140 and the sealing plug 122 defining a first bladder length 150 there between. The first end 92 of the electric conduit 96 and the second end 94 of the electric conduit 96 defining a first conduit length 152 there between. The first conduit length 152 has a first greater length 154 than the first bladder length 150 for permitting displacement of the electric conduit 96 relative to the elongated bladder 60. The displacement of the electric conduit 96 relative to the elongated bladder 60 producing a strobe light effect 156 for the location beacon 24 in that the elongated bladder is constructed from a translucent material 56. In addition, the displacement of the electric conduit 96 relative to the elongated bladder 60 permitting the elongated bladder 60 to be positioned into the coil configuration 74 as shown in FIG. 2.

As shown in FIG. 15 the bottom end 159 of the peripheral strap 142 and the sealing plug 122 defining a second bladder length 160 there between. The first end 92 of the electric conduit 96 and the second end 94 of the electric conduit 96 defining a second conduit length 162 there between. The second conduit length 162 has a second greater length 164 than the second bladder length 160 for permitting displacement of the electric conduit 96 relative to the elongated bladder 60. The displacement of the electric conduit 96 relative to the elongated bladder 60 producing a strobe light effect 156 for the location beacon 24 in that the elongated bladder is constructed from a translucent material 56. In addition, the displacement of the electric conduit 96 relative to the elongated bladder 60 permitting the elongated bladder 60 to be positioned into the coil configuration 74 as shown in FIG. 2.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A light emitting inflatable safety beacon for identifying a location of the beacon, the light emitting inflatable safety beacon, comprising:

an elongated bladder defining an interior chamber extending between an upper end and a lower end;

a tether extending between a first end and a second end;

a couple linking said tether with said elongated bladder for suspending said tether within said interior chamber;

a light source securing to said tether for emitting an electromagnetic radiation;

said electromagnetic radiation internally illuminating said elongated bladder for creating an illuminated beacon; and said electromagnetic radiation traversing said elongated bladder for creating a location beacon.

2. A light emitting inflatable safety beacon as set forth in claim 1, further including a valve traversing said elongated bladder for permitting the inflation and deflation of said elongated bladder.

3. A light emitting inflatable safety beacon as set forth in claim 1, further including a clip securing to said elongated bladder for retaining said elongated bladder to an object.

4. A light emitting inflatable safety beacon as set forth in claim 1, wherein said tether includes an electric conduit;

a current source secured to said elongated bladder and electrically coupled to said electric conduit;

said light source including a plurality of light-emitting diodes electrically coupled to said electric conduit; and a current control device for opening or closing the current path between said current source and said plurality of light-emitting diodes.

5. A light emitting inflatable safety beacon as set forth in claim 1, wherein said tether includes an electric conduit;

said couple includes an upper couple and a lower couple;

said upper couple linking said first end of said tether to said upper end of said elongated bladder;

said lower couple linking said second end of said tether to said lower end of said elongated bladder;

a current source secured to said elongated bladder and electrically coupled to said electric conduit;

said light source including a plurality of light-emitting diodes electrically coupled to said electric conduit; and a current control device for opening or closing the current path between said current source and said plurality of light-emitting diodes.

6. A light emitting inflatable safety beacon as set forth in claim 1, wherein said tether includes an electric conduit;

a sealing plug traversing said elongated bladder for receiving said electric conduit;

a current source secured to said sealing plug for positioning said current source outside of said interior chamber and electrically coupled to said electric conduit;

said light source including a plurality of light-emitting diodes electrically coupled to said electric conduit; and a current control device integral to said current source and opening or closing the current path between said current source and said plurality of light-emitting diodes.

7. A light emitting inflatable safety beacon as set forth in claim 1, wherein said tether includes an electric conduit;

said couple includes a strap linking said first end of said electric conduit to said upper end of said elongated bladder;

said couple further including a sealing plug linking said second end of said electric conduit to said lower end of said elongated bladder;

said sealing plug traversing said elongated bladder for receiving said electric conduit and positioning a portion of said electric conduit outside of said interior chamber;

a current source secured to said sealing plug for positioning said current source outside of said interior chamber and electrically coupled to said electric conduit;

said light source including a plurality of light-emitting diodes electrically coupled to said electric conduit; and a current control device integral to said current source and opening or closing the current path between said current source and said plurality of light-emitting diodes.

8. A light emitting inflatable safety beacon as set forth in claim 1, wherein said tether includes an electric conduit;

said couple includes a strap linking said first end of said electric conduit to said upper end of said elongated bladder;

said couple further including a sealing plug linking said second end of said electric conduit to said lower end of said elongated bladder;

said sealing plug traversing said elongated bladder for receiving said electric conduit and positioning a portion of said electric conduit outside of said interior chamber;

a current source secured to said sealing plug for positioning said current source outside of said interior chamber and electrically coupled to said electric conduit;

said light source including a plurality of light-emitting diodes electrically coupled to said electric conduit;

a current control device integral to said current source and opening or closing the current path between said current source and said plurality of light-emitting diodes;

said strap linking and said sealing plug linking defining a bladder length there between;

said first end of said electric conduit and said second end of said electric conduit defining a conduit length there between;

said conduit length defining a greater length than said bladder length for permitting displacement of said electric conduit relative to said elongated bladder; and said displacement of said electric conduit relative to said elongated bladder producing a strobe light effect for said location beacon.

9. A light emitting inflatable safety beacon as set forth in claim 1, wherein said tether includes an electric conduit;

said couple includes a strap linking said first end of said electric conduit to said upper end of said elongated bladder;

said couple further including a sealing plug linking said second end of said electric conduit to said lower end of said elongated bladder;

said sealing plug traversing said elongated bladder for receiving said electric conduit and positioning a portion of said electric conduit outside of said interior chamber;

a current source secured to said sealing plug for positioning said current source outside of said interior chamber and electrically coupled to said electric conduit;

said light source including a plurality of light-emitting diodes electrically coupled to said electric conduit;

a current control device integral to said current source and opening or closing the current path between said current source and said plurality of light-emitting diodes;

said strap linking and said sealing plug linking defining a bladder length there between;

said first end of said electric conduit and said second end of said electric conduit defining a conduit length there between;

said conduit length defining a greater length than said bladder length for permitting displacement of said electric conduit relative to said elongated bladder; and said displacement of said electric conduit relative to said elongated bladder permitting said elongated bladder to define a coil configuration for storing said elongated bladder.

10. A light emitting inflatable safety beacon for identifying a location of the beacon, the light emitting inflatable safety beacon, comprising:

an elongated bladder defining an interior chamber extending between an upper end and a lower end;

a tether extending between a first end and a second end;

a couple linking said tether with said elongated bladder for suspending said tether within said interior chamber;

a light source securing to said tether for emitting an electromagnetic radiation;

said electromagnetic radiation internally illuminating said elongated bladder for creating an illuminated beacon;

said electromagnetic radiation traversing said elongated bladder for creating a location beacon;

said tether includes an electric conduit;

a sealing plug traversing said elongated bladder for receiving said electric conduit;

a current source secured to said sealing plug for positioning said current source outside of said interior chamber and electrically coupled to said electric conduit;

said light source including a plurality of light-emitting diodes electrically coupled to said electric conduit; and a current control device integral to said current source and opening or closing the current path between said current source and said plurality of light-emitting diodes.

11. A light emitting device for illuminating an inflatable safety beacon, the inflatable safety beacon including a translucent and elongated bladder defining an interior chamber extending between an upper end and a lower end, the light emitting device, comprising:

a tether extending between a first end and a second end;

a couple linking said tether with the elongated bladder for suspending said tether within said interior chamber;

a light source securing to said tether for emitting an electromagnetic radiation;

said electromagnetic radiation internally illuminating the elongated bladder for creating an illuminated beacon; and said electromagnetic radiation traversing the translucent bladder for creating a location beacon.

* * * * *